US006416354B1

(12) United States Patent
Lee

(10) Patent No.: US 6,416,354 B1
(45) Date of Patent: Jul. 9, 2002

(54) CONNECTOR ASSEMBLY HAVING ROTATABLE PULL MECHANISM

(75) Inventor: George Lee, Taipei (TW)

(73) Assignee: Hon Hai Precision Ind. Co., Ltd., Taipei Hsiena (TW)

( * ) Notice: Subject to any disclaimer, the term of this patent is extended or adjusted under 35 U.S.C. 154(b) by 0 days.

(21) Appl. No.: 09/932,022

(22) Filed: Aug. 17, 2001

Related U.S. Application Data

(63) Continuation-in-part of application No. 09/812,538, filed on Mar. 19, 2001.

(51) Int. Cl.[7] ..... H01R 13/06
(52) U.S. Cl. ..... 439/484; 439/459
(58) Field of Search ..... 439/456, 459, 439/483, 484, 405, 404

(56) References Cited

U.S. PATENT DOCUMENTS 6,074,237 A * 6/2000 Lee ..... 439/405
6,126,479 A * 10/2000 Lee ..... 439/484
6,132,241 A * 10/2000 Hwang ..... 439/405

* cited by examiner

*Primary Examiner*—Gary Paumen
(74) *Attorney, Agent, or Firm*—Wei Te Chung

(57) ABSTRACT

An electrical connector assembly (1; 1*a*; 1*b*) includes an electrical connector (3; 3*a*; 3*b*) comprising an insulative housing (30; 30*a*; 30*b*) and a plurality of electrical contacts, a dielectric cover (5; 5*a*; 5*b*) coupled to the electrical connector and a pull leash (7; 7*a*; 7*b*) assembled to the electrical connector. The pull leash is rotatable on the housing.

1 Claim, 17 Drawing Sheets

CONNECTOR ASSEMBLY HAVING ROTATABLE PULL MECHANISM

CROSS REFERENCE TO RELATED APPLICATION

This application is a Continuation-In-Part of U.S. application Ser. No. 09/812,538 filed Mar. 19, 2001.

BACKGROUND OF THE INVENTION

1. Field of the Invention

The present invention relates to an electrical connector assembly, and particularly to an electrical cable connector assembly having a pull mechanism to facilitate disengaging the electrical cable connector assembly from a mating complementary electrical connector.

2. Description of the Related Art

A conventional electrical cable connector assembly for a flat cable usually comprises an electrical connector including electrical contacts, each having an engaging end for engaging with a corresponding conductor of a flat cable by Insulation Displacement Connection (IDC) and a mating end for mating withan electrical contact of a complementary electrical connector. A dielectric cover presses the flat cable against the top of the electrical connector. In addition, a pull mechanism is usually provided for users to disengage the electrical cable connector assembly from the complementary electrical connector where a low profile electrical cable connector assembly is concerned. The low profile electrical connectors comply with miniaturization trends in the electronic field but access for users to disengage a low profile electrical cable connector assembly from a mating complementary electrical connector is often difficult.

The pull mechanism usually stands along a vertical direction above a top of the dielectric cover and the electrical connector of the electrical cable connector assembly, which inevitably increases the total height of the mated electrical cable connector assembly and complementary electrical connector and which runs counter to the initial design vision of low profile electrical connectors.

Therefore, an electrical cable connector assembly having an improved pull mechanism is required to overcome the disadvantages described above.

SUMMARY OF THE INVENTION

A major object of the present invention is to provide an electrical cable connector assembly having a pull mechanism, which facilitates users to disengage the electrical cable connector assembly from a mating complementary electrical connector without increasing the total height of the mated electrical cable connector assembly and complementary electrical connector.

To fulfill the above object, an electrical cable connector assembly in accordance with the present invention comprises an electrical connector, a dielectric cover and a pull leash. The electrical connector comprises an elongated insulative housing comprising a pair of opposite ends and a plurality of electrical contacts mounted between the opposite ends of the insulative housing.

The dielectric cover comprises a pair of cover ends and defines a lower surface having a configuration corresponding to a flat cable to tightly press the flat cable on the electrical connector and to reliably position electrical conductors of the flat cable for ensuring a reliable electrical Insulation Displacement Connection (IDC) between the electrical conductors and the electrical contacts.

The pull leash assembled to the housing is rotatable from a first position where a leash body thereof stands above an upper surface of the dielectric cover to a second position where the leash body is positioned flush with or lower than the upper surface of the dielectric cover.

Other objects, advantages and novel features of the invention will become more apparent from the following detailed description of the present embodiment when taken in conjunction with the accompanying drawings.

DETAILED DESCRIPTION OF THE INVENTION

Figure 1:
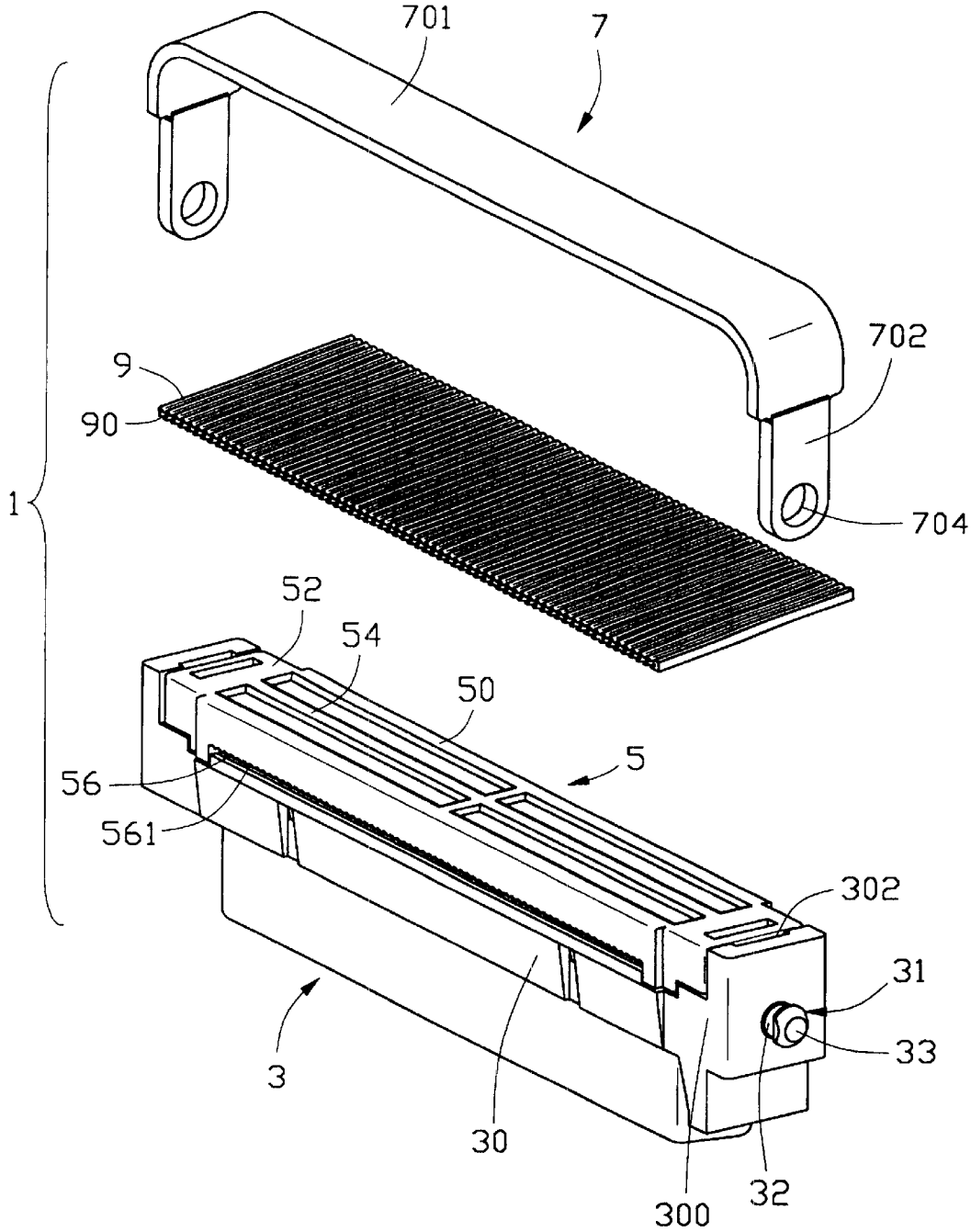
FIG. 1 is a partially exploded view of an electrical cable connector assembly for a flat cable in accordance with a first embodiment of the present invention.
Figure 2:
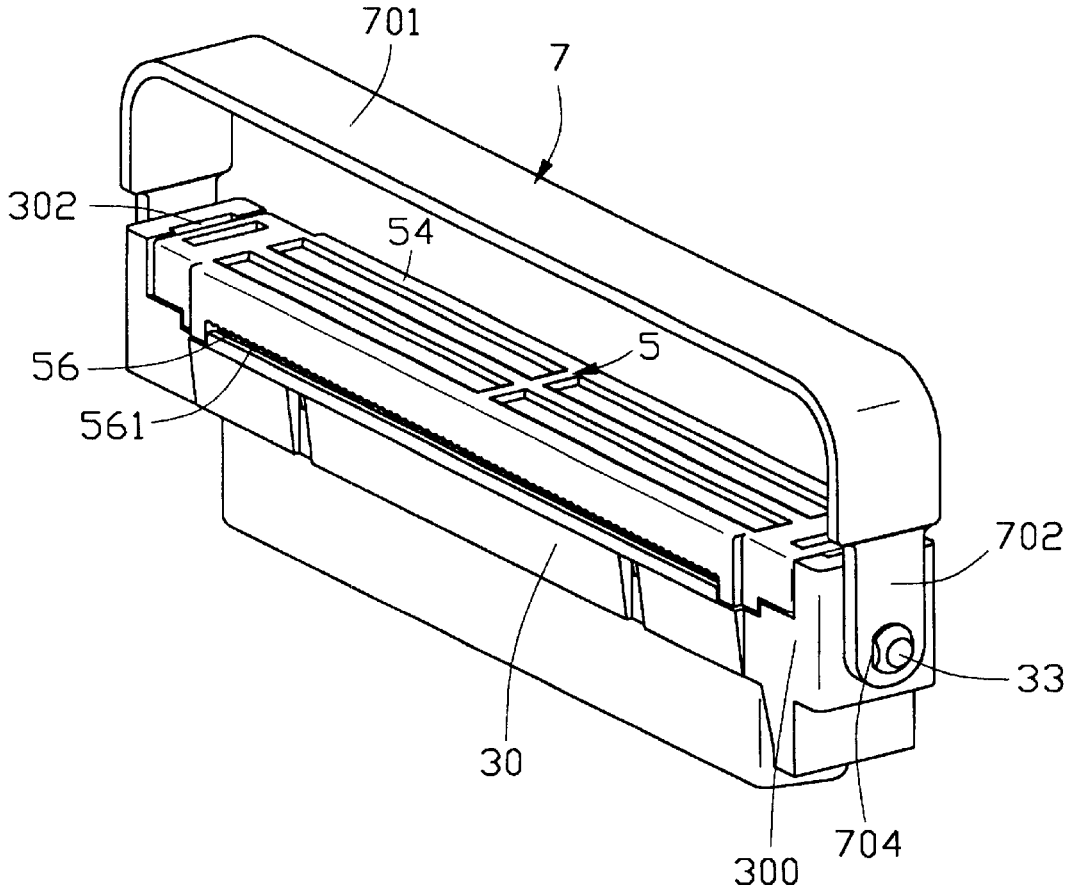
FIG. 2 is an assembled perspective view of FIG. 1 with the flat cable being omitted herefrom for clarity and with a pull leash of the electrical cable connector assembly being positioned at an operating position.
Figure 3:
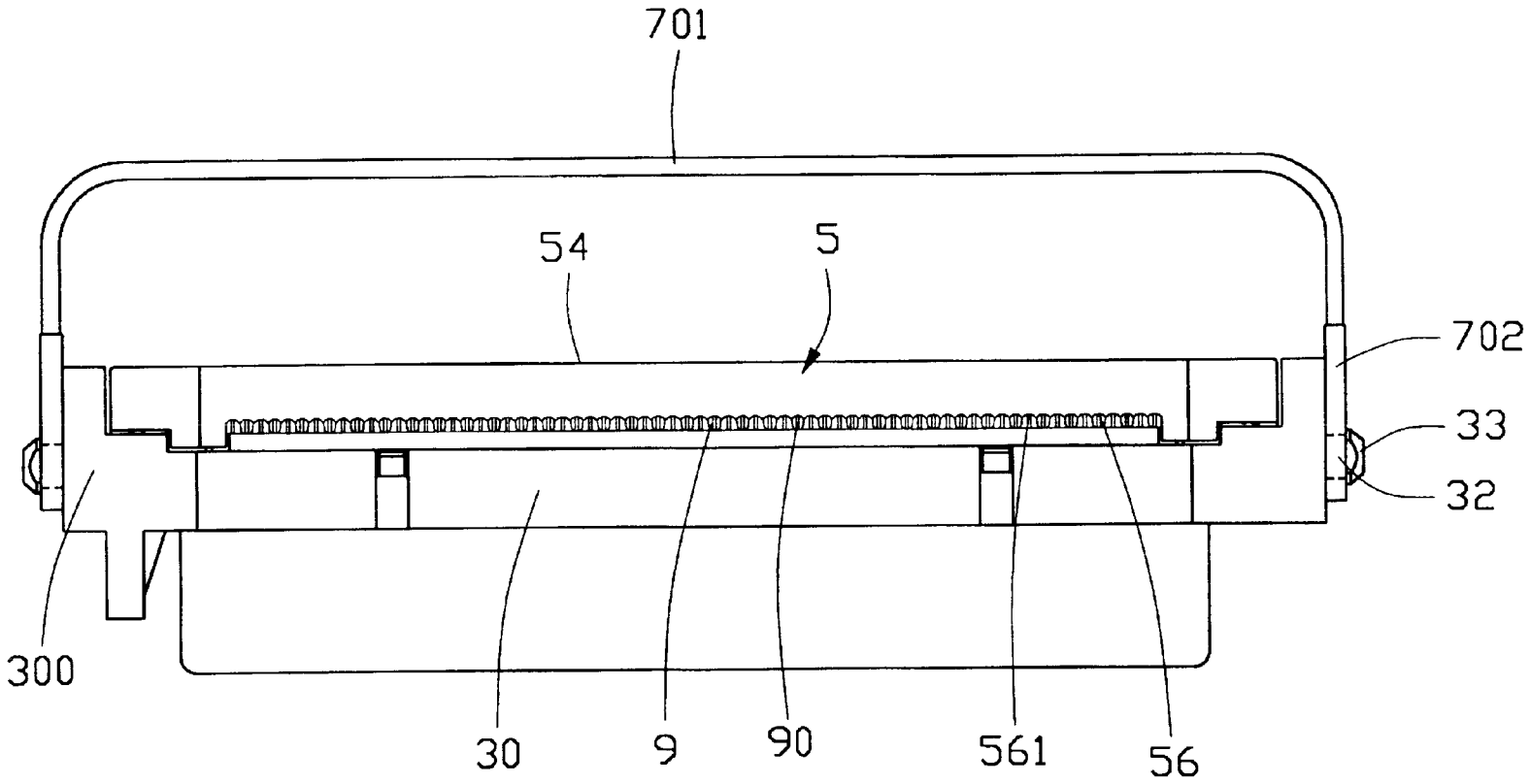
FIG. 3 is an enlarged front view of FIG. 2 with the flat cable assembled thereto.
Figure 4:
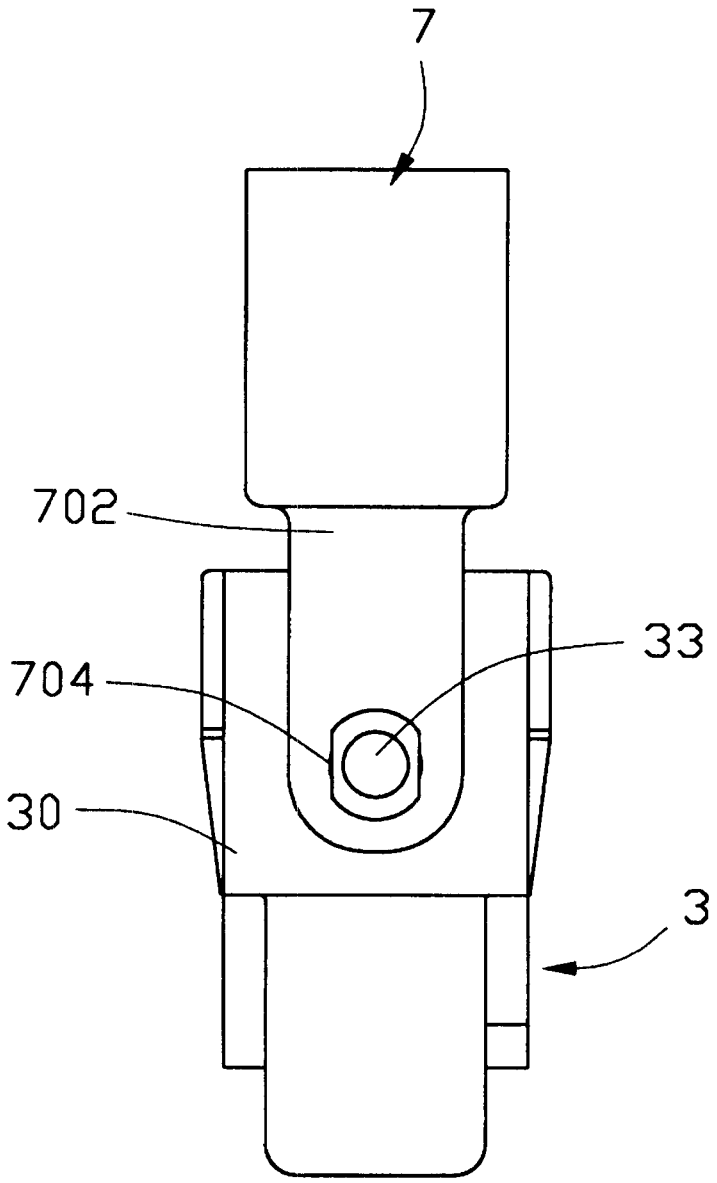
FIG. 4 is a side elevation view of FIG. 2.
Figure 5:
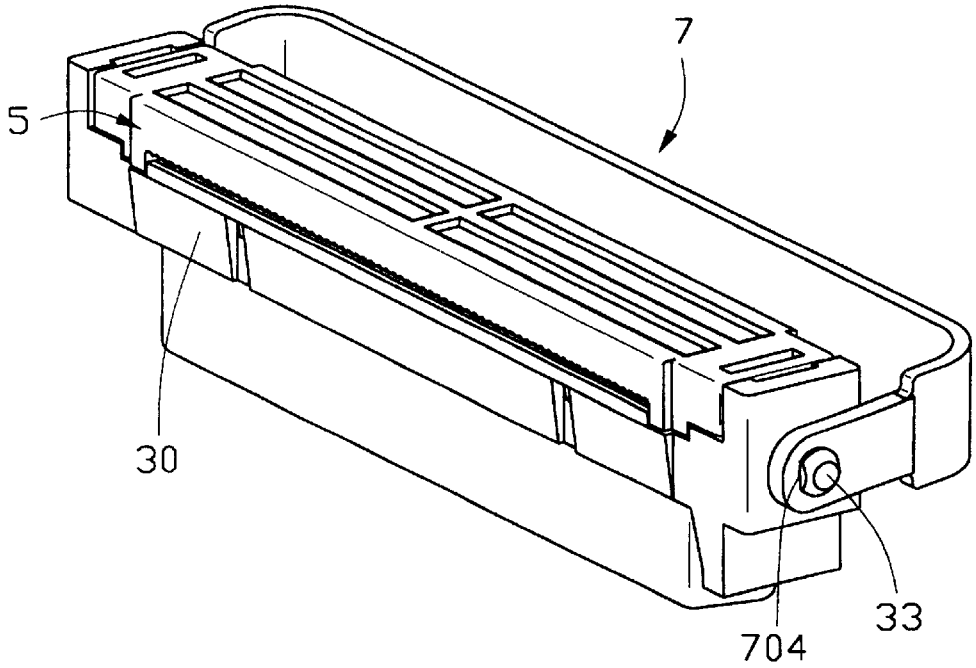
FIG. 5 is a view similar to FIG. 2, but with the pull leash being positioned at a resting position.
Figure 6:
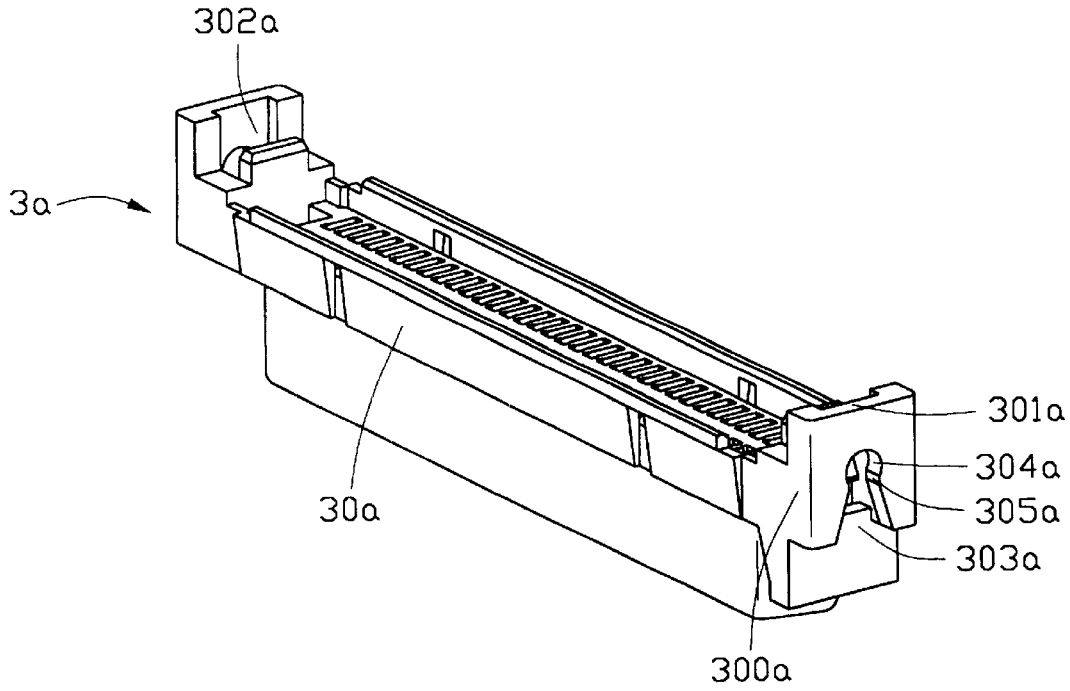
FIG. 6 is a perspective view of an insulative housing in accordance with a second embodiment of the present invention.
Figure 7:
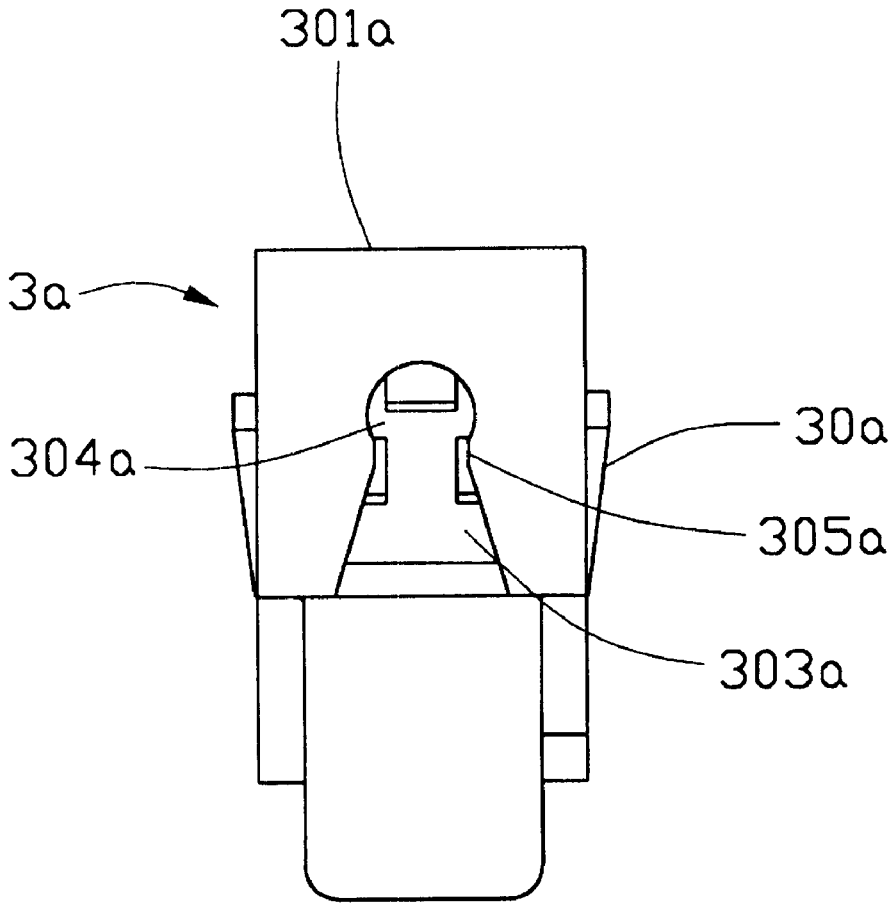
FIG. 7 is a side elevation view of FIG. 6.
Figure 8:
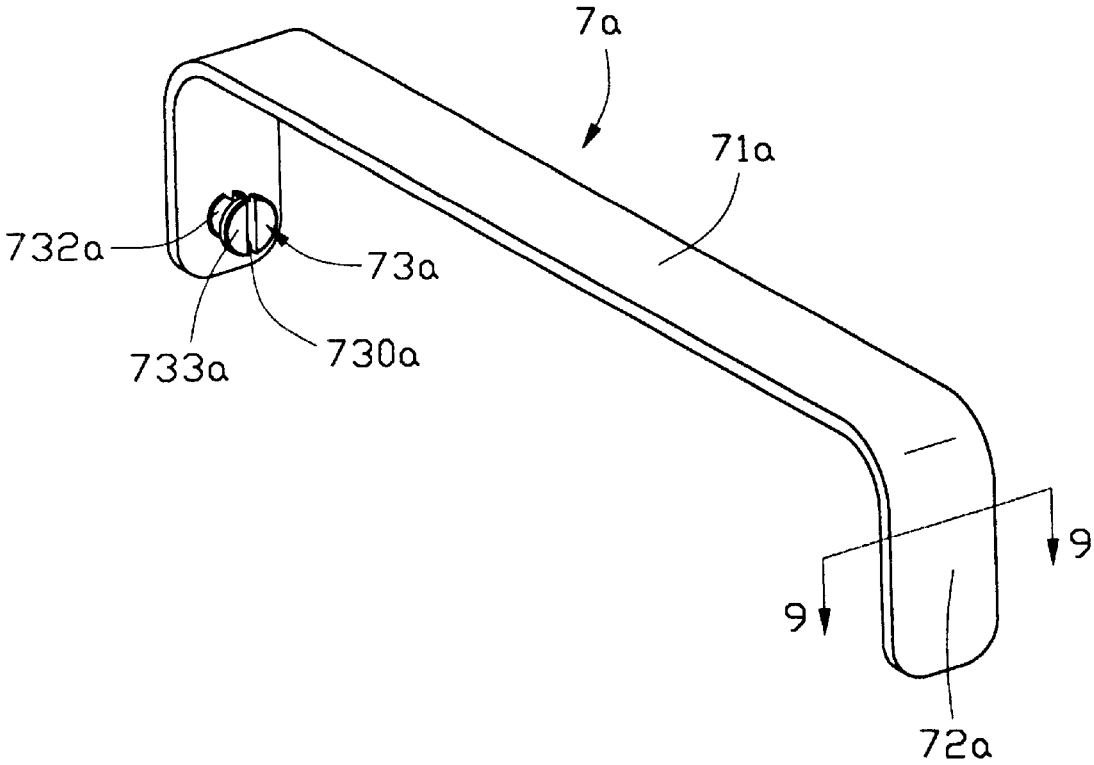
FIG. 8 is a perspective view of a pull leash in accordance with a second embodiment of the present invention.
Figure 9:
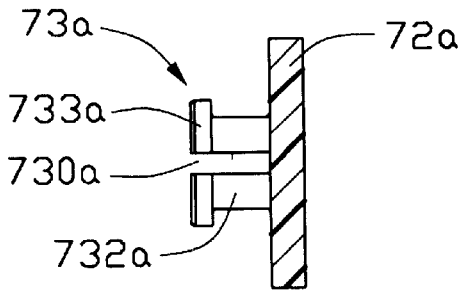
FIG. 9 is a cross-sectional view along line 9—9 of FIG. 8.
Figure 10:
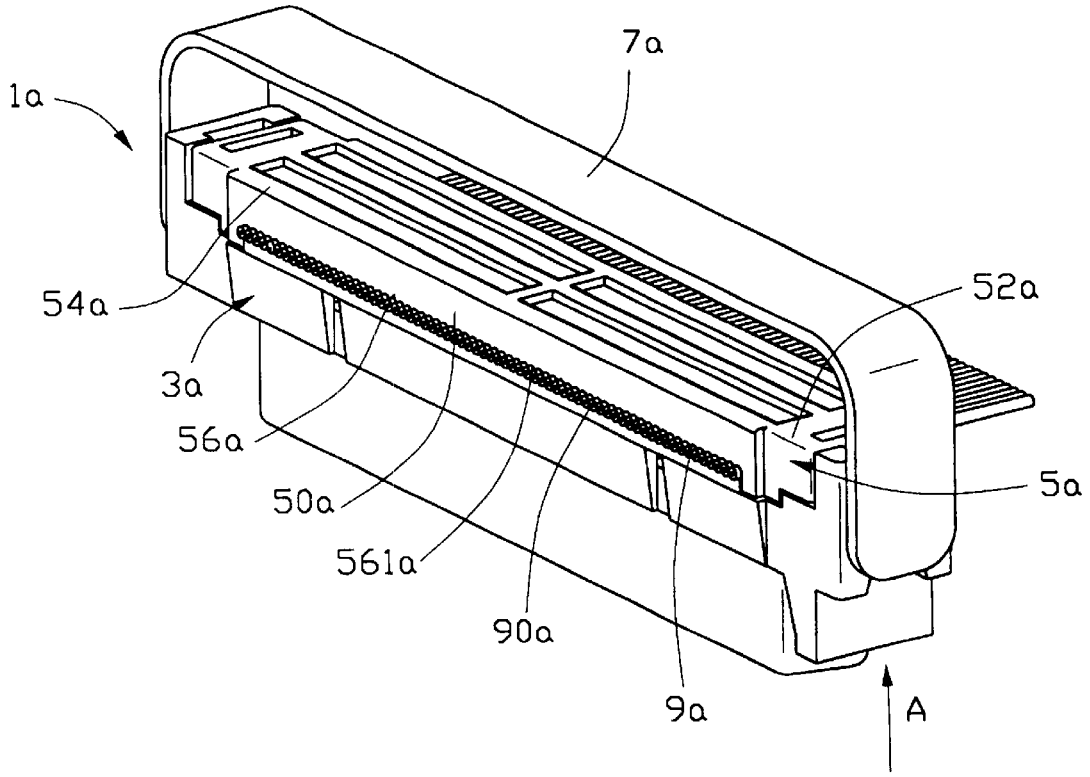
FIG. 10 is an assembled perspective view of the electrical cable connector assembly in accordance with a second embodiment of the present invention.
Figure 11:
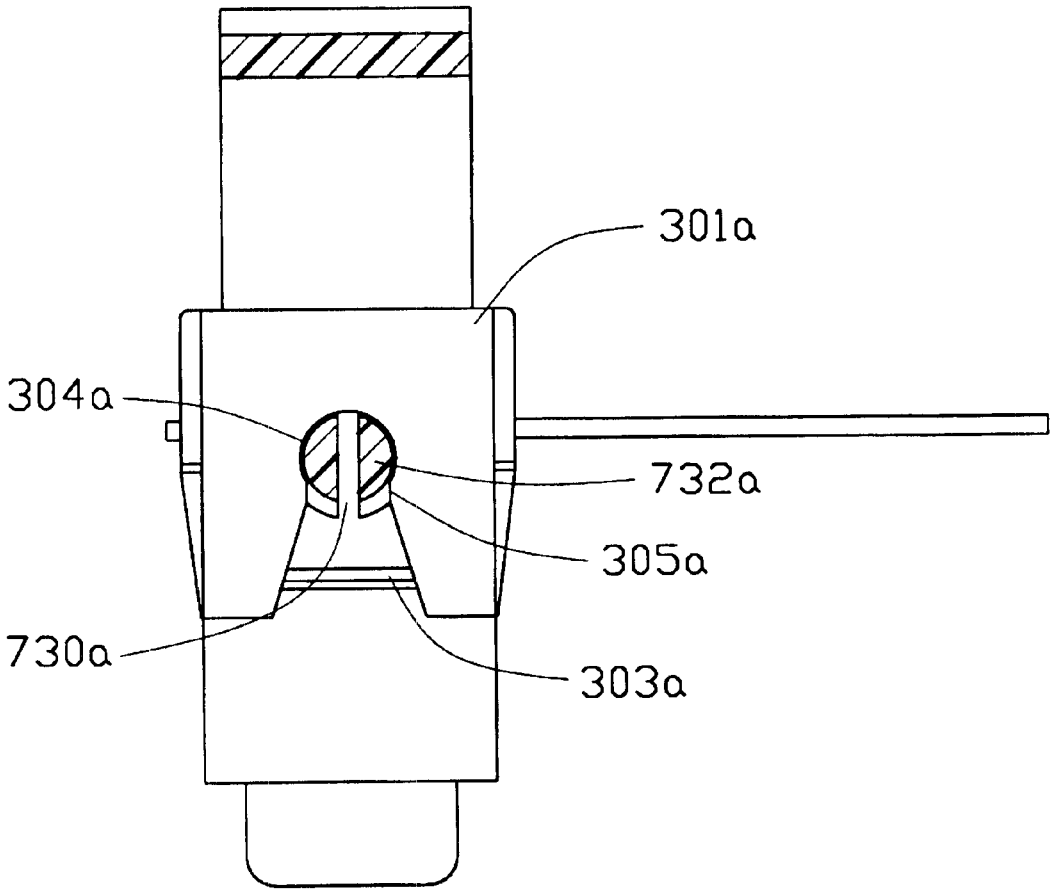
FIG. 11 is a side elevation view of FIG. 10 with the pull leash being partly cut away.
Figure 12:
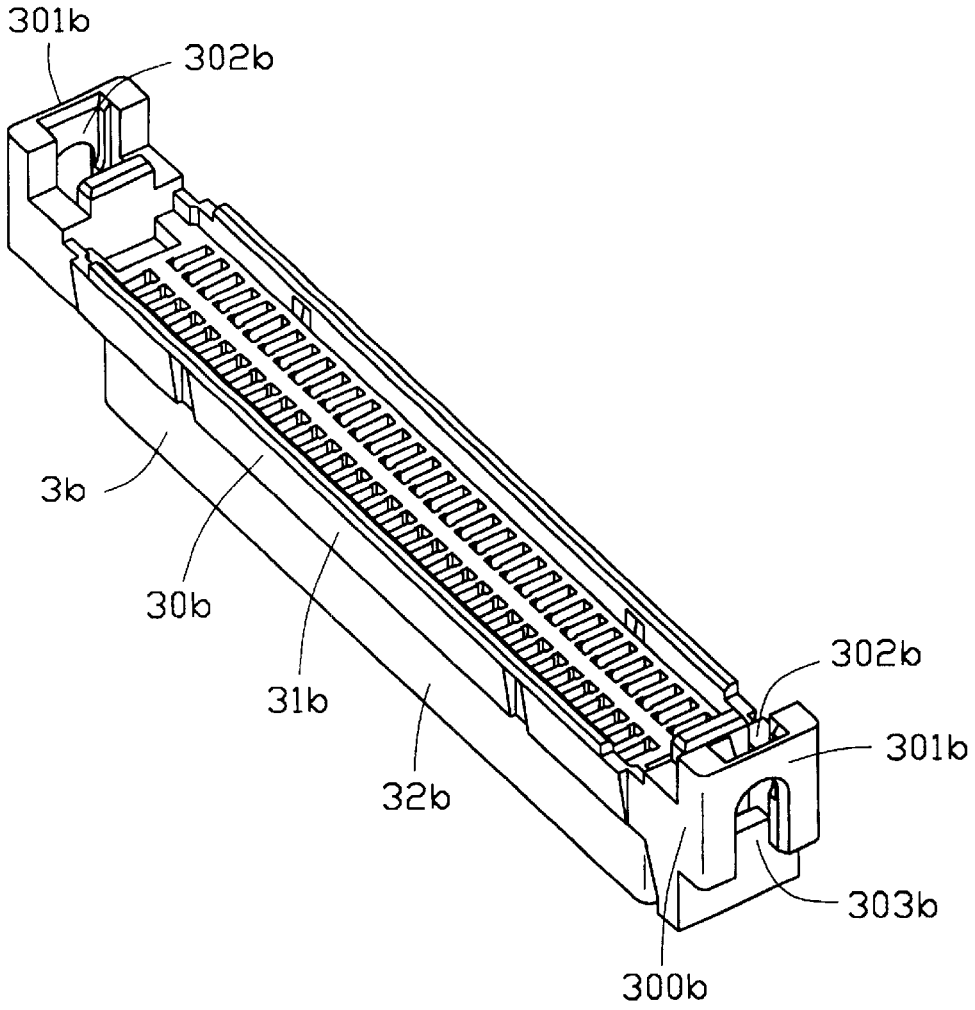
FIG. 12 is a perspective view of an insulative housing in accordance with a third embodiment of the present invention.
Figure 13:
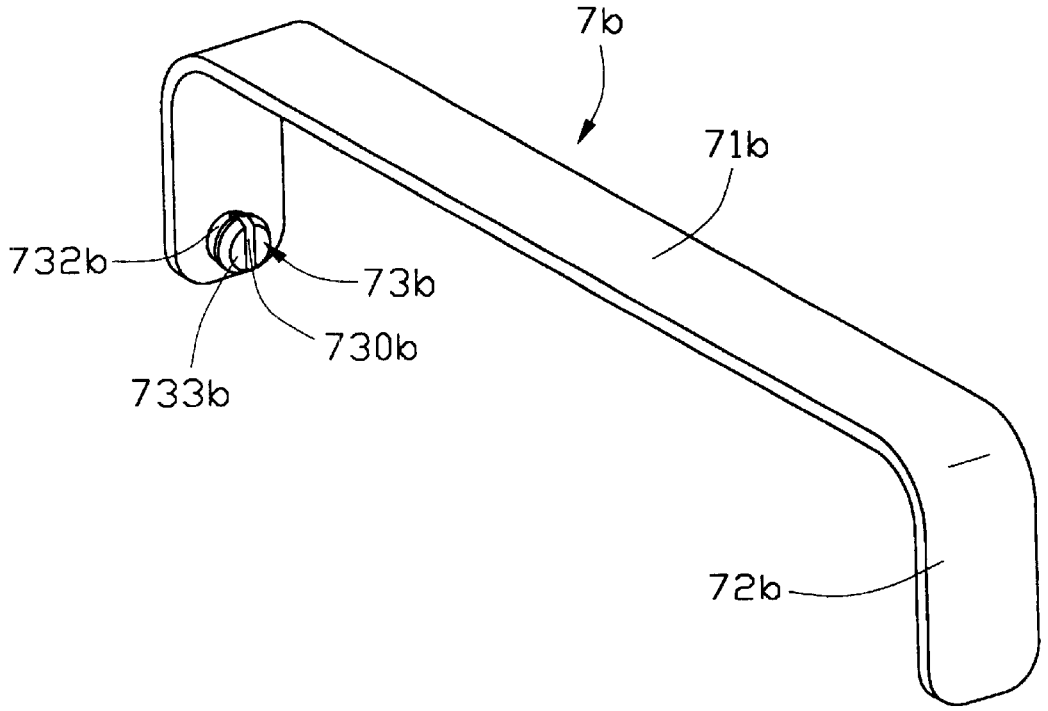
FIG. 13 is a perspective view of a pull leash in accordance with a third embodiment of the present invention.
Figure 14:
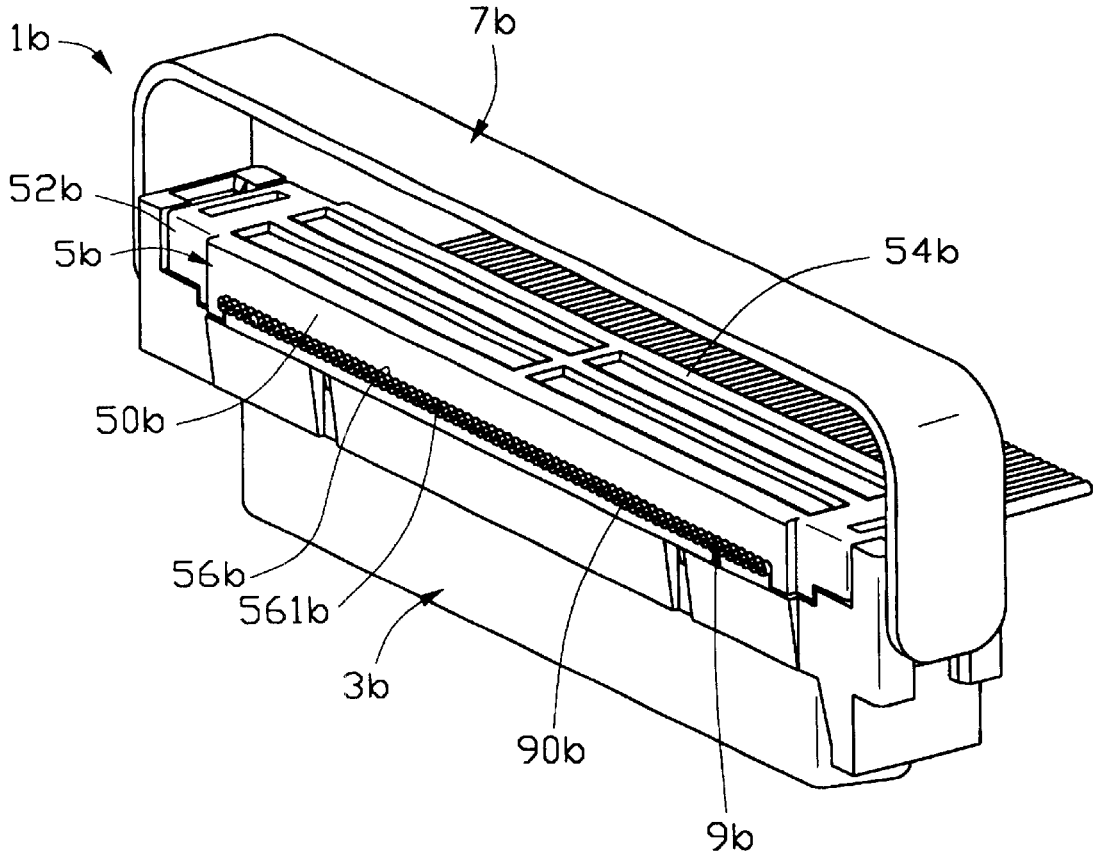
FIG. 14 is an assembled perspective view of the electrical cable connector assembly with the pull leash of FIG. 13 being attached to the insulative housing of FIG. 12.

Referring to FIGS. 1–5, an electrical cable connector assembly 1 in accordance with a first embodiment of the present invention comprises an electrical connector 3, a dielectric cover 5 for securing a flat cable 9 to the electrical connector 3, and a pull leash 7.

The electrical connector 3 comprises an elongated insulative housing 30 and a plurality of electrical contacts (not shown) retained therein. The insulative housing 30 comprises a pair of opposite ends 300, each of which defines a slot 302 extending from an upper section into a lower section thereof. A pair of opposite heads 31 protrudes outwardly from respective out walls of the ends 300. The head 31 is generally cylindrical and comprises a neck section 32 perpendicularly extending from the end 300 and an enlarged section 33 extending from the neck section 32 and having a diameter larger than the neck section 32. The electrical contacts are mounted in the insulative housing 30 between the opposite ends 300 in a manner known to persons skilled in the Insulation Displacement Connection electrical connector art.

The dielectric cover 5 comprises a pair of cover ends 52 and an elongated plate shaped main body 50 therebetween. The main body 50 defines an upper surface 54 and a lower surface 56 opposite to the upper surface 54. The lower surface 56 defines a plurality of recesses 561 configured corresponding to the shape of electrical conductors 90 of the flat cable 9 to properly position the electrical conductors 90.

The pull leash 7 is made of high performance plastic material, such as Nylon, and comprises an elongated leash body 701 and a pair of extensions 702 formed at two opposite ends of the leash body 701. Each extension 702 defines a circular hole 704 therein. The diameter of the hole 704 is a little larger than the diameter of the neck section 32 of the head 31. Thickness of the extension 702 is substantially equal to the length of the neck section 32.

In assembly, the flat cable 9 is put on the insulative housing 30. The dielectric cover 5 is then pressed on the insulative housing 30 to cause the electrical contacts to have an Insulation Displacement Connection (IDC) with the electrical conductors 90 of the flat cable 9, wherein the electrical contacts and the electrical conductors 90 are respectively received in the recesses 561. The electrical connector 3 and the dielectric cover 5 are fixedly connected together with the insulative housing 30.

For attaching the pull leash 7 to the housing 30, the extensions 702 are first urged away from each other, the holes 704 of the extensions 702 contact with the head 31, and then the extensions 702 are pushed inward to cause the neck sections 32 be received into the holes 704. The pull leash 7 is restrained from escaping from the heads 31 due to the larger diameters of the enlarged sections 33 than the neck sections 32 and the holes 704. The pull leash 70 is rotatable round the neck sections 32 of the heads 31.

Referring to FIGS. 6–11, an electrical cable connector assembly 1*a* in accordance with a second embodiment of the present invention comprises an electrical connector 3*a*, a dielectric cover 5*a* for coupling an electrical flat cable 9*a* (FIG. 10) to the electrical connector 3*a*, and a pull leash 7*a*. The electrical connector 3*a* comprises an elongated insulative housing 30*a* and a plurality of electrical contacts (not shown). The insulative housing 30*a* comprises a pair of opposite ends 300*a*, each of which defines a slot 302*a* extending therethrough. Two opposite side walls 301*a* are formed on the housing 30*a*. A fan-shaped cutout 303*a* is recessed from a lower end of each side wall 301*a* and communicates with the slot 302*a*. One end of the cutout 303*a* is formed as a circular hole 304*a*. A pair of opposite projections 305*a* is formed below the circular hole 304*a*, and the distance between the two projections 305*a* is smaller than the diameter of the hole 304*a*. The electrical contacts are mounted in the insulative housing 30*a* between the opposite ends 300*a*.

The dielectric cover 5*a* comprises a pair of cover ends 52*a* and a main body 50*a* therebetween. The main body 50*a* comprises an upper surface 54*a* and a lower surface 56*a* opposite to the upper surface 54*a*. The lower surface 56*a* defines a plurality of recesses 561*a* configured to correspond to the shape of electrical conductors 90*a* of the flat cable 9*a* to properly position the electrical conductors 90*a*.

The pull leash 7*a* is made of high performance plastic material, such as Nylon, and comprises a leash body 71*a* and a pair of extensions 72*a* formed at two opposite ends of the leash body 71*a*. A pair of support shafts 73*a* is formed respectively on inner faces of the extensions 72*a* in coaxial relation to each other. A split groove 730*a* is defined in the support shaft 73*a* to divide the same into two portions along the length thereof, so that the support shaft 73*a* can be resiliently deformed to be reduced in diameter. The support shaft 73*a* includes a neck section 732*a* perpendicularly extending from the extension 72*a* and an enlarged section 733*a* extending from the neck section 732*a* and having a diameter larger than the neck section 732*a*. The diameter of neck section 732*a* is a little larger than the diameter of the hole 304*a* of the housing 30*a*. The length of the neck section 732*a* is substantially equal to the thickness of the side wall 301*a*.

In assembly, the flat cable 9*a* is put on the insulative housing 30*a*. The cover 5*a* is then pressed on the insulative housing 30*a* to cause the electrical contacts to have an IDC with electrical conductors 90*a* of the flat cable 9*a*, wherein the electrical contacts and electrical conductors 90*a* are respectively received in the recesses 561*a*. The electrical connector 3*a* and the dielectric cover 5*a* are connected together in ordinary ways known to persons skilled in the pertinent art.

For attaching the pull leash 7*a* to the housing 30*a*, the support shafts 73*a* are moved upwardly along the direction indicted by an arrow"A". The neck section 732*a* is brought into contact with the projections 305*a* of the side walls 301*a*. As a result, the neck sections 732*a* are elastically deformed to close the split groove 730*a*, so that the shafts 73*a* are allowed to be further moved into the circular holes 304*a*. The holes 304*a* of side wall 301*a* receive the neck sections 732*a* of the support shafts 73*a*. The pull leash 7*a* is restrained from escaping due to the larger dimension of the enlarged section 733*a* than the neck section 732*a* and the smaller distance between the two projections 305*a* than the dimension of the neck section 732*a*. The pull leash 7*a* is pivotable in the holes 304*a* of side wall 301*a*. The pull leash 7*a* is rotatable from a first position where the leash body 71*a* is located above the upper surface 54*a* of the dielectric cover 5*a* to a second position where the leash body 71*a* is located flush with or lower than the upper surface 54*a* of the dielectric cover 5*a*.

Figure 15:
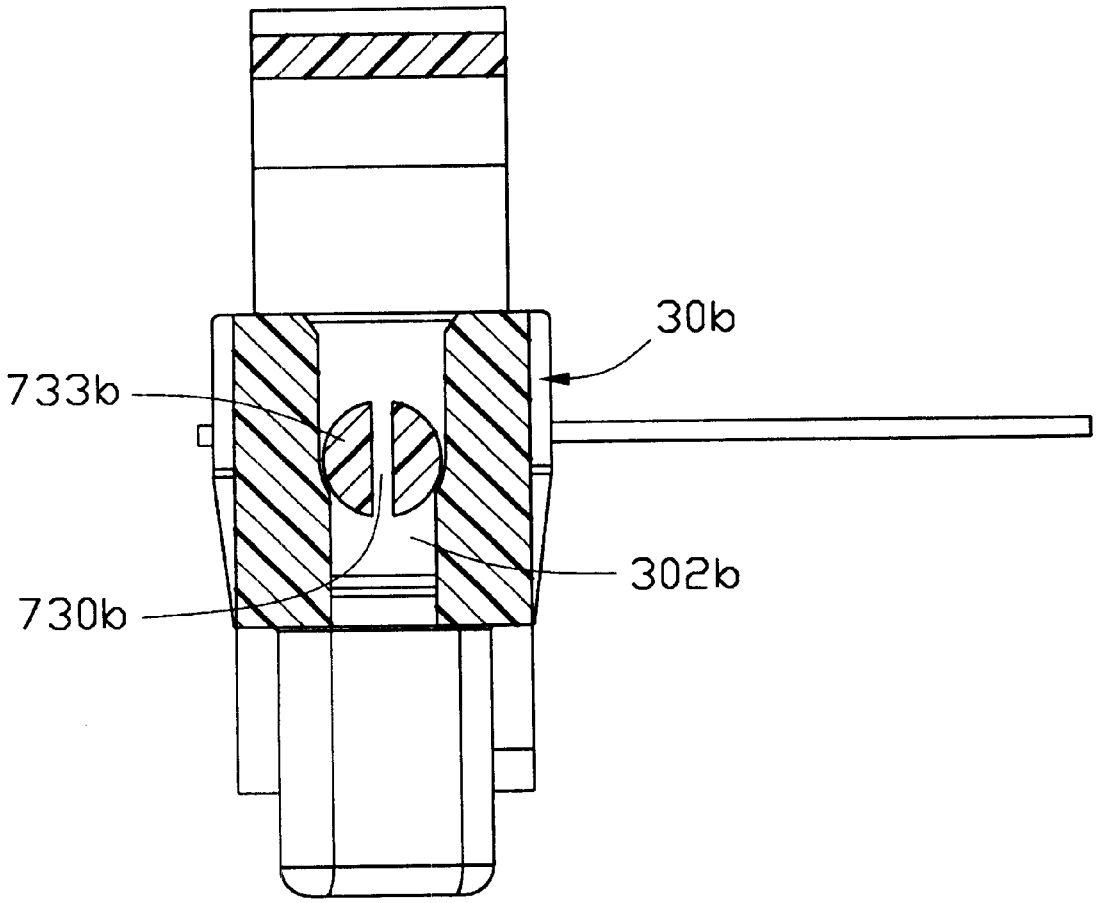
FIG. 15 is a cross-sectional view in accordance with a third embodiment of the present invention.
Figure 16:
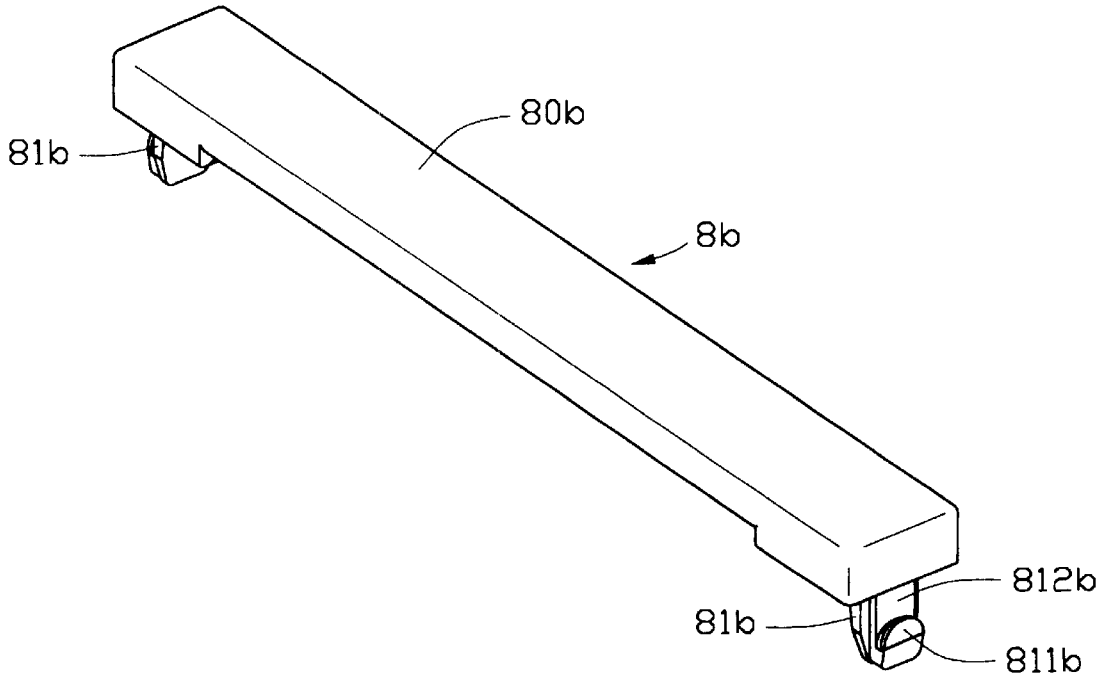
FIG. 16 is a perspective view of a strain relief in accordance with a third embodiment of the present invention.
Figure 17:
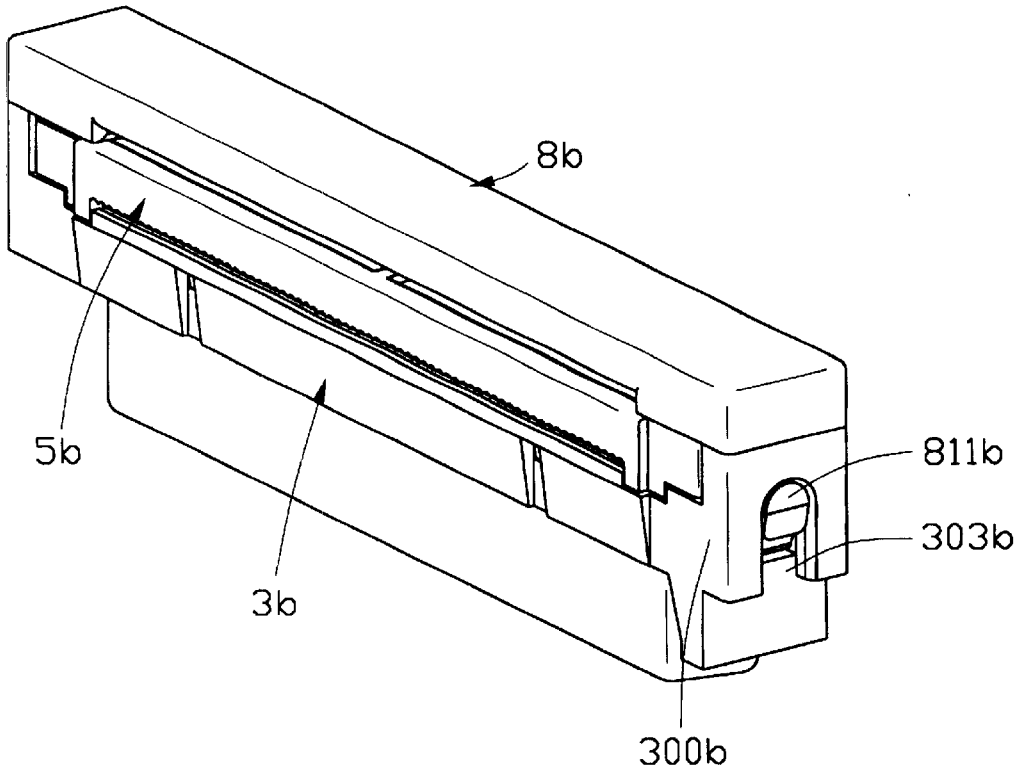
FIG. 17 is an assembled perspective view of the electrical cable connector assembly with the flat cable being omitted herefrom for clarity and the strain relief of FIG. 16 being attached to the connector.
Figure 18:
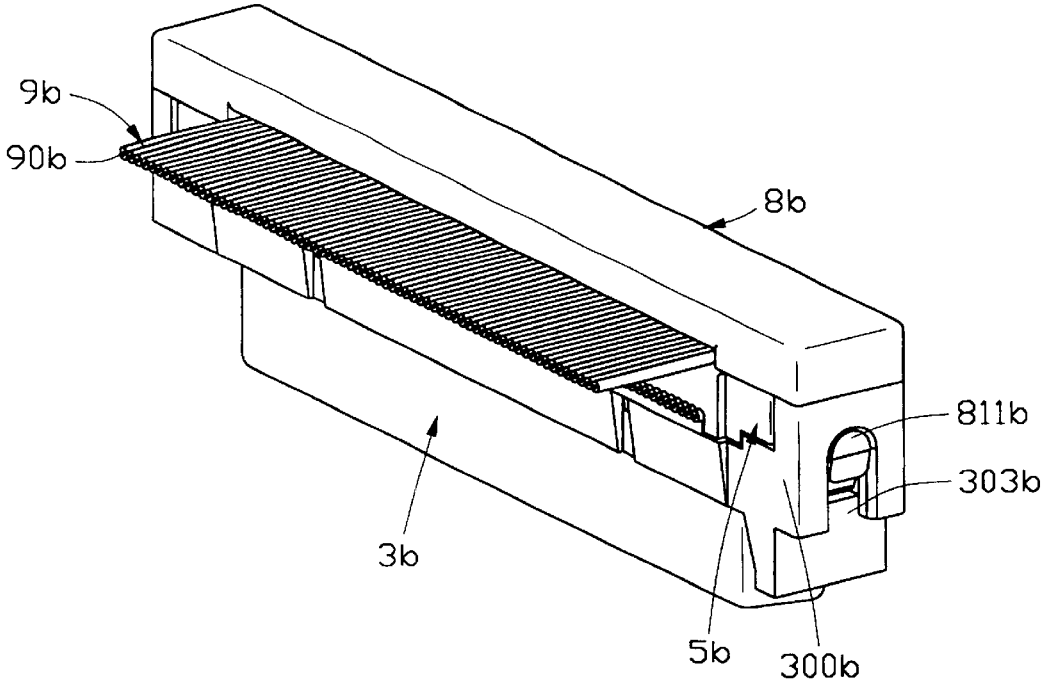
FIG. 18 is a view similar to FIG. 17, but with the flat cable assembled thereto.

Referring to FIGS. 12–18, an electrical cable connector assembly 1*b* in accordance with a third embodiment of the present invention comprises an electrical connector 3*b*, a dielectric cover 5*b* for coupling an electrical flat cable 9*b* (FIGS. 14, 18) to the electrical connector 3*b*. A pull leash 7*b* and a strain relief 8*b* are alternately assembled on the electrical connector 3*b*. The electrical connector 3*b* comprises an elongated insulative housing 30*b* and a plurality of electrical contacts (not shown). The insulative housing 30*b* comprises a base portion 31*b*, and a mating portion 32*b* extending from the base portion 31*b*. The base portion 31*b* comprises a pair of opposite ends 300*b*, each of which defines a slot 302*b* extending from an upper section into a lower section thereof. As best shown in FIG. 15, the upper section of the slot 302*b* is larger than that of the lower section. Two opposite side walls 301*b* are formed outside of the slot 302*b*. A vaulted cutout 303*b* is recessed from a lower face of each side wall 301*b*. The electrical contacts are mounted in the insulative housing 30*b* between the opposite ends 300*b*.

The dielectric cover 5*b* comprises a pair of cover ends 52*b* and a main body 50*b* therebetween. The main body 50*b* comprises an upper surface 54*b* and a lower surface 56*b* opposite to the upper surface 54*b*. The lower surface 56*b* defines a plurality of recesses 561*b* configured to correspond to the shape of electrical conductors 90*b* of the flat cable 9*b* to properly position the electrical conductors 90*b*.

The pull leash 7*b* comprises a leash body 71*b* and a pair of extensions 72*b*. A pair of support shafts 73*b* is formed respectively on the extensions 72*b*. The support shaft 73*b* comprises a neck section 732*b*, an enlarged section 733*b*, and a split groove 730*b*. The pull leash 7*b* is in many respects similar to the pull leash 7*a* shown in the second embodiment and thus need not be described in detail. The enlarged section 733*b* has a diameter larger than the neck section 732*b*. The diameter of the neck section 732*b* is slightly smaller than the width of the cutout 303*b*, and the diameter of the enlarged section 733*b* is larger than the width of the lower section of the slot 302*b*. The length of the neck section 732*b* is substantially equal to the thickness of the side wall 301*b*.

The strain relief 8*b* comprises an elongate insulative board 80*b*. Two legs 81*b* extend downwardly from two opposite ends of the board 80*b*. A hook 811*b* is formed on a lower section of each leg 81*b* and is dimensioned to be engaged with the cutout 303*b*. A recess 812*b* is defined in the leg 81*b* above the hook 811*b*.

The dielectric cover 5*b* is engaged with the housing 30*b* in the same way as the second embodiment of the present invention.

The pull leash 7*b* and the strain relief 8*b* are alternately attached to the insulative housing 30*b*. For attaching the pull leash 7*b* to the housing 30*b*, the extensions 72*b* are first urged away from each other, and the enlarged section 733*b* is brought into contact with the cutout 303*b* of the side wall 301*b*. As a result, the enlarged sections 733*b* are elastically deformed to close the split groove 730*b*, so that the shafts 73*b* are allowed to be further moved into the cutouts 303*b*. The cutouts 303*b* of the side wall 301*b* receive the neck sections 732*b* of the support shafts 73*b*, and the slots 302*b* receive the enlarged sections 733*b*. The pull leash 7*b* is restrained from escaping due to the larger dimension of the enlarged section 733*b* than the neck section 732*b* and the width of lower section of the slots 302*b*. The pull leash 70*b* is pivotable in the cutout 303*b* of the housing 30*b*.

For attaching the strain relief 8*b* to the housing 30*b*, the legs 81*b* extend into the slots 302*b* till the hook 811*b* is received into the cutout 303*b*. The strain relief 8*b* and the electrical connector 3*b* are fixedly connected together with the side wall 301*b* preventing the upward movement of the hook 811*b*.

In use, the pull leash of the electrical connector assembly in accordance with the present invention is rotatable from an operating position where the leash body is located in line with the dielectric cover and the electrical connector and above the upper surface of the dielectric cover to a resting position where the leash body is perpendicular to the dielectric cover and the electrical connector and is substantially flush with or lower than the upper surface of the dielectric cover. When the electrical connector assembly is mating with a complementary electrical connector and the electrical contacts thereof electrically contact with electrical contacts of the complementary electrical connector, the pull leash is positioned at the resting position as desired, whereby a vertical height of the mated electrical cable connector assembly and the complementary electrical connector is reduced. The strain relief is not only used to reduce the vertical height of the mating electrical cable connector assembly, but also reduce the stress of the cable assembly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A flat cable connector assembly, comprising:

an elongated insulative housing comprising a pair of opposite ends and receiving a plurality of electrical contacts therein;

an elongated dielectric cover assembled to the insulative housing, the dielectric cover comprising an upper surface and a lower surface opposite to the upper surface and covering about the electrical contacts;

a flat cable extending between the insulative housing and the lower surface of the dielectric cover and having conductors electrically connecting with the electrical contacts;

a pull leash having a leash body and a pair of extensions; and a strain relief comprising an elongate insulative board and two leg extending downwardly from a lower face of and proximate to opposite ends of the board; wherein the pull leash and the strain relief are alternately mounted on the insulative housing;

wherein each end of the insulative housing defines a slot therethrough, the slot including an upper section and a lower section, the upper section being larger than the lower section, and the insulative housing comprises two opposite side walls each defining a vaulted cutout recessed from a lower face thereof, the cutout being in communication with the slot;

wherein the extensions of the pull leash comprise a pair of opposite support shafts on respective inner faces thereof, the support shafts being in coaxial relation to each other;

wherein each support shaft defines a split groove to divide the same into two portions along the length thereof, the support shaft including a neck section perpendicularly extending from the extension and an enlarged section extending from the neck section and having a diameter larger than the neck section;

wherein each leg of the strain relief comprises a hook on a lower section thereof, the hook being dimensioned to be engaged into and hook onto the cutout.

* * * * *